US005188254A

United States Patent [19]

Evans

[11] Patent Number: 5,188,254

[45] Date of Patent: Feb. 23, 1993

[54] BAG HOLDING SYSTEM FOR RECYCLABLES

[76] Inventor: Harold A. Evans, 10 Merrymount Dr., Swampscott, Mass. 01907

[21] Appl. No.: 872,164

[22] Filed: Apr. 21, 1992

[51] Int. Cl.[5] ..... B65D 1/24

[52] U.S. Cl. ..... 220/404; 220/909

[58] Field of Search ..... 220/404, 403, 529, 909, 220/908

[56] References Cited

U.S. PATENT DOCUMENTS

| | | | |
|---|---|---|---|
| 4,418,835 | 12/1983 | Watts | 220/404 |
| 4,834,260 | 5/1989 | Auten | 220/404 |
| 4,905,853 | 3/1990 | Strander | 220/909 |
| 4,974,746 | 12/1990 | Dickinson | 220/404 |
| 5,033,641 | 7/1991 | Martin | 220/909 |
| 5,058,763 | 10/1991 | Dickinson | 220/909 |

*Primary Examiner*—Joseph Man-Fu Moy
*Attorney, Agent, or Firm*—J. D. Marshall

[57] ABSTRACT

This invention enables the storage of several recyclable materials in a single container by providing a method of dividing ribs and an attachment method that attaches plastic bags to the ribs by the interaction between holes in a fastened flexible strip and projecting knobs located on the dividing ribs. The invention works to hold the bags best when a keyhole, or round, or oval hole is used and the strip is slightly stretched to fit over each projecting knob so that when the strip elastically rebounds after stretching it applies a force to the bag material that surrounds the projecting knob.

20 Claims, 5 Drawing Sheets

BAG HOLDING SYSTEM FOR RECYCLABLES

FIELD OF INVENTION

The invention relates to the division of containers into compartments, with each compartment holding a bag, for the separation of trash or recyclable materials into the different bags. It allows three or more compartments to be used within one container.

SUMMARY OF INVENTION

This invention utilizes a multiply divided top of a garbage or trash can to hold a series of bags on separating ribs which hold bags open and in position for the easy separation of garbage and trash or the separation of various types of recyclable materials. The bags hang downward into the can. The invention uses projections on the separating ribs which interact with holes in a flexible strip which overlies each separating rib and sandwiches a portion of the top of the plastic bag between the projection and the hole which is pressed downward over the projection. Each flexible strip is attached at one end to the separating rib it covers so that the strips cannot be lost. The strips have a keyhole shape or a round shape hole and the shape of the hole and the stretch of the strip interact to make the strip firmly hold the bag to the rib. In use one bag will be placed into each separation between the separating ribs and the edges of adjacent bags will overlie the separating ribs and be held by the projections interacting with the strips.

BACKGROUND AND PRIOR ART

The American trash based society is changing. Recycling, formerly frowned upon, is becoming both a needed fad and a ordinance enforced necessity. Along with this trend toward recycling, the number of apartment, condominium and small house dwellers is expanding as living styles and affluence change.

The normal way to separate trash or recyclable materials has been to devote a bag or container to each type. As recycling becomes more precise in determining the values of the various components the number of containers needed has multiplied. It is not unusual for glass to be collected in three colors, clear, green and amber; for cans to require another storage space; and for paper; cardboard and several types of plastics to be curbside or recycle center separated. With this diversity of different materials being collected, the storage space requirement has also been multiplied. There is a need for compact storage methods.

The simplest method of collection and storage was to line up a series of garbage cans. This was easy and relatively cheap. It was also so space intensive that many users could not use the method.

The next popular storage method was the use of bins that lined up in a row, typically each in a frame and with a bag to hold the recyclables. This also was only a small saving in space, acting like a series of smaller square garbage cans.

There have been a variety of storage methods to reach the market that attempted to reduce the size and cost of the early bin approach. The most obvious was a series of plastic mini bins, color coded or labeled in some cases, which were stackable. These bins were convenient to use and they could be carried to the curb easily. The disadvantages were that when stacked they could fall, and they still required a lot of space to use effectively. These bins remain bulky and hard to use.

As recycling became more common, there were further refinement including use of compartmented containers. Typically three or four compartments were formed by placing dividers in the cans, or by providing grid which fit so that it would support one or more bags, typically fastened with individual spring clamps that engaged the can top or grid and hold the bag in place. These U shaped grips or clamps were effective but they easily got lost. In a few cases these clamps had ties holding them to the can but the ties also would break. Without the clamps, there was little use for the cover since the bag was not held in place.

DESCRIPTION OF THE INVENTION

In this invention a compact compartmented recyclables storage container is made useful.

The invention provides an improved gripping action of bags against the top dividing rib of a divided container that prevents loss of the clamps.

The invention allows a distributed force on the bags held, thus allowing thinner bags, yet does not weaken the bag by puncturing it.

The invention further allows an easy use of a lid on the container.

The invention consists of a new improved configuration top and a system of clamping holddowns that firmly grip plastic bags and hold them to the cover ribs.

The system first consists of a series of ribs that radiate from a central point and which may intercept and connect to a circular rim that fits over a typical garbage can or trash can of 30 to 50 gallon size. Shapes other than circular can also be accommodated with different rims.

The system in addition to the radial ribs, each of which has sides—had fastening strips attached to the ribs so there can be no lost clamps. The system clamps consist of a series of projections in the hard plastic of the ribs which mate with holes punched in a flexible strip of rubbery plastic. Bags are placed between the projection and the strip. While several shapes of holes can be used, keyhole shapes with the smaller portion in the direction opposite to the direction of the fastening point of the strip are especially good since slight stretching of the strip allows the projection to fit into the strip hole and the snap back of the stretched strip firmly holds the bags and the projection.

It is also noted that the flexible strip could be pinned, bolted, glued or welded to the dividing ribs. The permanently pinned version is attractive since it absolutely prevents the problem of lost or detached fasteners.

In the versions above, the flexible strips are usually attached together at the center of the ribs where all ribs intersect. The flexible strips can also be attached to each rib separately. In this case, the strips are attached by a multitude of essentially identical part assemblies located identically on each rib instead of one common pin holding all strips. There are a number of molded or formed fasteners that can be utilized to provide an attachment between the parts. A stake element going through a hole in the strips to a mating hole in the rib or an arrow shaped tab going through the strips and pressed and deformed to fit through a mating hole or slot in the rib are examples of attachments that would work well in this invention.

The pin has an advantage in that it is self fastening and needs no nut or threaded portion. A bolt or screw can also be used but these provide an attachment that is less permanent, requires more parts, and tools are required to assemble the strips. The rib part must be provided with holes to accommodate any fasteners. A single piece pin allows a number of clamp strips to be joined at the center junction point of the ribs and the part can be assembled with a single fastener for the strips.

Keeping the last side of the triangular compartment open was solved after it was realized that the invention does not require weight on the plastic bag since the bags are long enough to reach the bottom of the container. As a result of the bag length, the container and not the clamps support the weight of the contents. This allows the use of tape, or of folding the outer edge under a rim as a method to secure the loose outer side of the bag.

Turning now to the use of the invention, the garbage can with the top section of this invention set on the top of the can is prepared for use. The flexible strips are pulled back and drape into an unused segment. A plastic liner bag is opened and placed with the bottom seal down into one of the divisions of the top. The bottom seal reaches to the bottom of the of the top. The bottom seal reaches to the bottom of the container. Part of the top edge of this first bag is then draped over the dividing rib located on one side of the compartment. A second bag is opened and placed in a similar manner into the adjacent compartment with the sealed end down. Part of the top edge of this bag is now draped over the same divider so that there are two layers of plastic film going in opposite directions over this dividing rib. The flexible strip is now pulled back over the rib. The holes in the strip nearly match the projections on the rib. When the strip is elastically elongated a small amount by pulling on it, the holes match. With this stretching pull to align the projections and holes, the strip is pressed downward so the holes engage the strip and surround the projections and the plastic film of the bags that cover the projections. As the pull is released, the strip snaps back slightly putting pressure on the projections that hold the bag in place. A firm fit of the flexible strip holes over the film and projections provides a positive grip on the bags. When firmly held over the projections the bags are prevented from moving. The first bag is now pressed toward the center of the dividers and then along the other rib in that compartment. The side near the other rib is then draped over the remaining dividing rib in that compartment. A bag is placed in the adjacent compartment, sealed end down, and the process of draping one edge over the rib and clamping the edge is repeated until there are bags in all of the compartments. The final compartment is the one where the first bag was located. When the loose edge of this first bag draped over the last dividing rib and clamped, the unit is ready for use.

The invention is useful in this form since the bags are held open in separate compartments. The invention is slightly enhanced by the further opening of the rim side of the bag that is adjacent to the outer rim of the container.

There are a number of effective ways to keep this last side of the triangular opening held open. The invention used on the ribs can also be used on the rim edge of the container and top. Here thers is less demand for holding power and the only need is a tacking force to keep the bag open. The inner half of the inverted U shape described above is all that is needed and it was found that a partial rim also worked well. The partial rim consists of the inner half of the u shape. To cure the size sensitivity and to give a feeling of perfect fit, projecting ribs, bumps, or knobs were placed in the outer rim projecting outward to slightly deform the flexible rim of the can. The partial rim is also beneficial since it allows the lid that comes with the container to be used in this invention.

THE PREFERRED EMBODIMENTS

Figure 1:
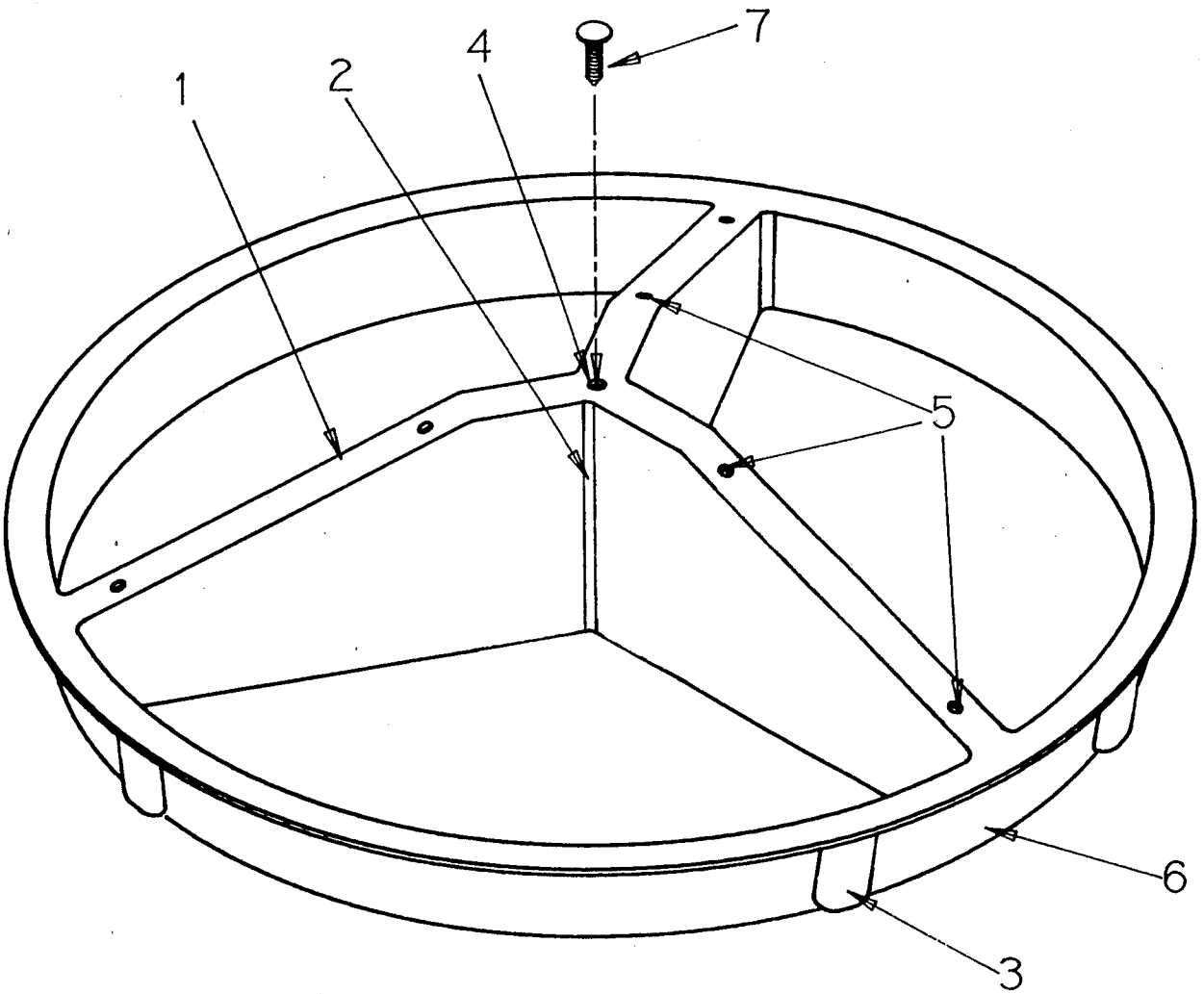
In FIG. 1, the dividing ribs 1 are shown radiating from a central point 2 on a garbage can top device. The ribs are attached to a partial rim 3 which supports the ribs. A central holding hole 4 and a series of rib holes 5 are shown. Projections 6 in the rim aid in better fit of the device. An attachment that can fit through the holes is shown as 7.

In the preferred embodiment the multisectioned can lid shown in FIG. 1 is produced by thermoforming it and the flexible strips shown as 10 are extruded and punched with holes 11. Knobs, 12, are made separately and installed with staking pins.

The can lid is made on a form that is initially wood but which will be a machined aluminum mold as volume increases. The mold has the shape of the inside of the lid and while the wood form is not cooled, an aluminum form would be water cooled to speed the forming process. The mold is a male mold which means that the parts such as the rim, 3, and dividers, 1, project upward from the base of the mold. Such a male molding has the advantage that the thickest portions of the final product are the top sections and the web at the bottom of the dividers is the thin part of the final product which somewhat aids trim operations.

The material used is a sheet of ABS plastic of a high impact grade. This material is readily available in flat finish and texture finish grades in a variety of colors. The sheet is a continuous wound sheet that is ⅛th inch thick and which has a 24 inch width. The sheet is clamped on two edges as it is unwound and it enters a preheat zone to bring the temperature close to the softening point then advanced into a second stage where it is heated to slightly soften the plastic. This last heating cycle is timed although the visible sign of the proper temperature is a slight droop in the sheet at the center. The sheet is then advanced to the forming stage and the mold is raised upward toward the sheet while there is a vacuum applied through small drilled holes in the mold. The combination of contact with the sheet and the pulling of the vacuum causes the soft plastic sheet to be pulled down onto and in close contact with the mold as the soft plastic sheet hardens by contact with the relatively cool mold. The deformed sheet is then die cut at least around the outer rim to remove it from the sheet, and this rim and rib section is removed and stacked for trim operations.

The next part of the process is the trim operations where the excess sheet is removed. In this type product, a formed epoxy female mold is used and the part set in this mold in the reverse position as in the thermoformer has the continuous web and other bottom parts of the part upward. The part is then passed under a grinder that acts like a large planer and reduces the flat bottom waste part of the plastic molded sheet to a ground waste product that can be recycled into more sheet product. This single pass of the planer like grinder results in a totally trimmed part.

The can lid and its segments are now in final form but there is no bag holding attachments. The knobs, 12, that are added to the lid are a fungible commercial product. The particular knobs used are attached by a nut threaded on the bottom shaft. This screw in attachment is can be enhanced by application of a drop of glue at the base of each knob prior to assembly so the knobs are both solvent glued and screwed into the separating ribs. The product now only lacks the flexible strips to be fully functional.

Figure 4:
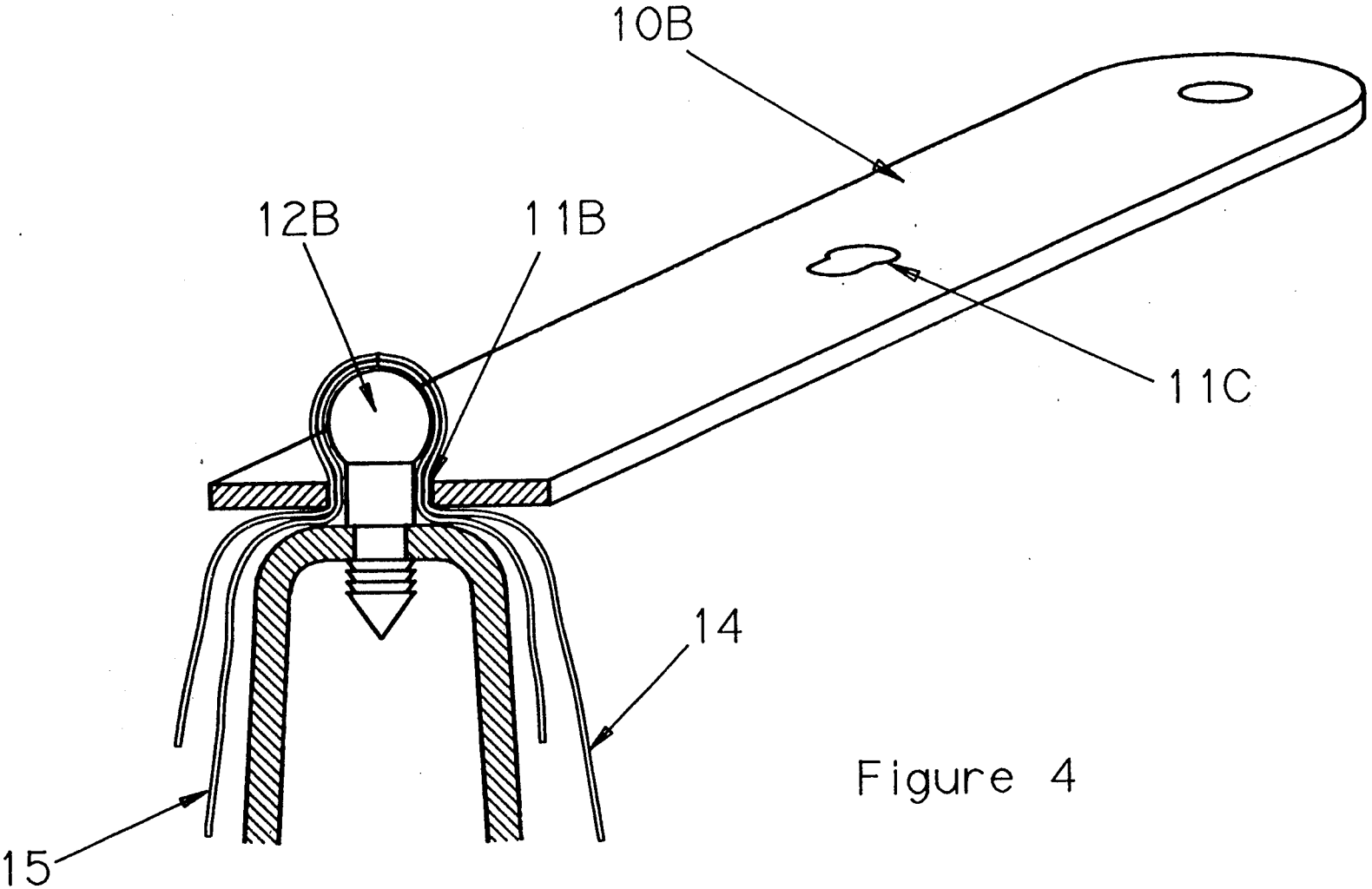
In FIG. 4, the knobs 12B, the strip 10B with its hole 11B, the bag material 14 of a first bag, and the bag material 15 of a second bag, are shown arrayed on rib 1C in cross section through a knob. The strip 10C is also shown with holes 11C shapes as keyhole shape. The knob 11C is shown mounted in rib 1D.

The flexible strips, shown in the Figures as 10, are 1/16th inch thick plasticized PVC strip. While any color is available, a clear strip provides the quality image needed for this project. The clear strip may also be printed with a label or a set of labels may be supplied with the strips to identify each compartment that glue under the clear strip. The strip is punched with spaced holes, 11, to accommodate the spacing of the projecting knobs, 12. The holes can be round but in this version, they are keyhole shaped and aligned such that the keyhole as shown in FIG. 4 part 11C will have its smaller portion directed away from the strip attaching pin. The holes are spaced so that the wider part of the hole perfectly aligns with the projection when the strip is slightly stretched. The strip must thus be capable of slight elastic stretching and then rebounding to its original length. The holes can also be a deformed round shape which is obround, or oval. The strip is then cut into three strips of the proper length and the three strips are attached with a staking pin, 7, to a hole provided in the central hub of the dividers and shown as 4. The strips are arranged so one strip extends over each dividing rib and the key shaped holes are properly aligned.

Figure 2:
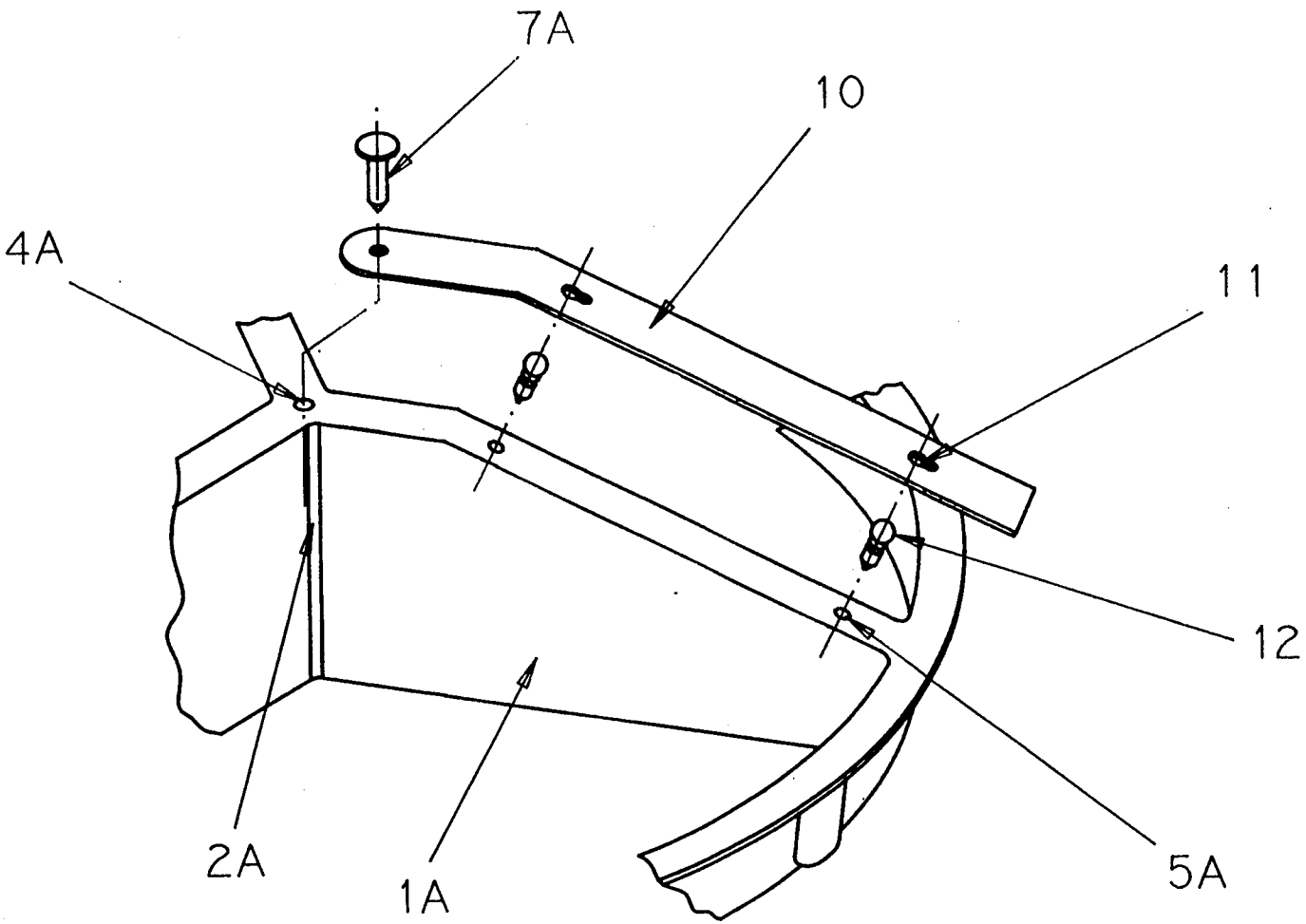
In FIG. 2, the can top is shown in an assembly view with the rib 1A joined at a central point 2A which has hole 4A. The rib has holes 5A into which knobs 12 are stakably fitted while flexible strip 10 with holes 11 is pinned to the center point by staking pin 7A.
Figure 3:
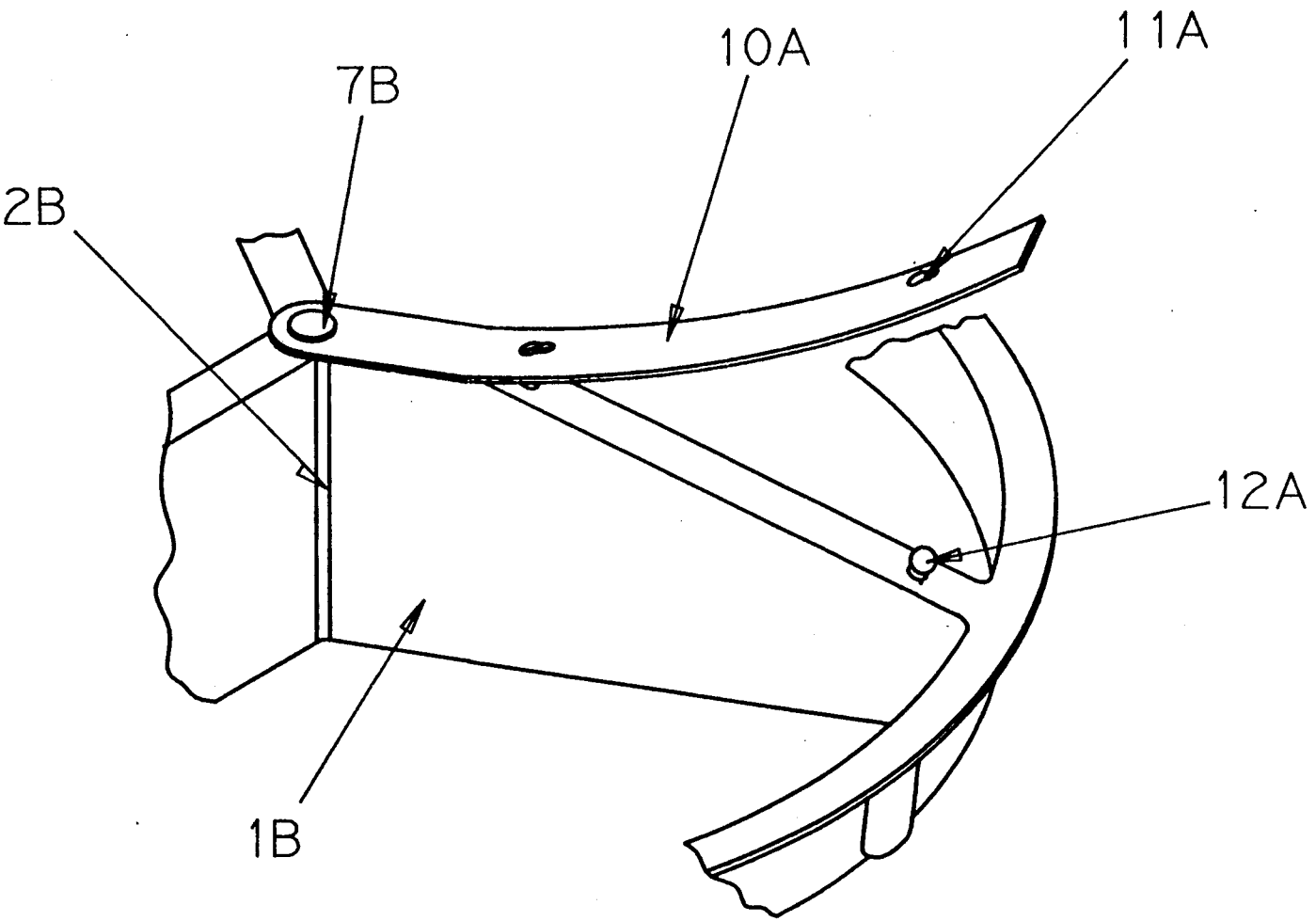
In FIG. 3, the can top is shown in a fully assembled view with the rib 1B joined at a central point 2B. The rib has holes into which knobs 12A are stakably fitted while flexible strip 10A with holes 11A is pinned to the center point by staking pin 7B.

In the most preferred embodiment the product was shown as a completely assembled product as in FIG. 3. This product in a second embodiment is shown as a kit as in assembly drawing, FIG. 2, with the finished can lid supplied after it is trimmed. The lid is also provided with a set of vacuum formed indentations that act to help start self tapping screws where the knobs, 12, and the strip attachment, 7, is located. The knobs are supplied separately with self tapping screws to attach them and a tube of glue to apply the adhesive. The strips are cut to length after punching and also supplied for customer attachment. The kit sold in this form reduces the labor content drastically by having the customer do the simple assembly steps.

Figure 5:
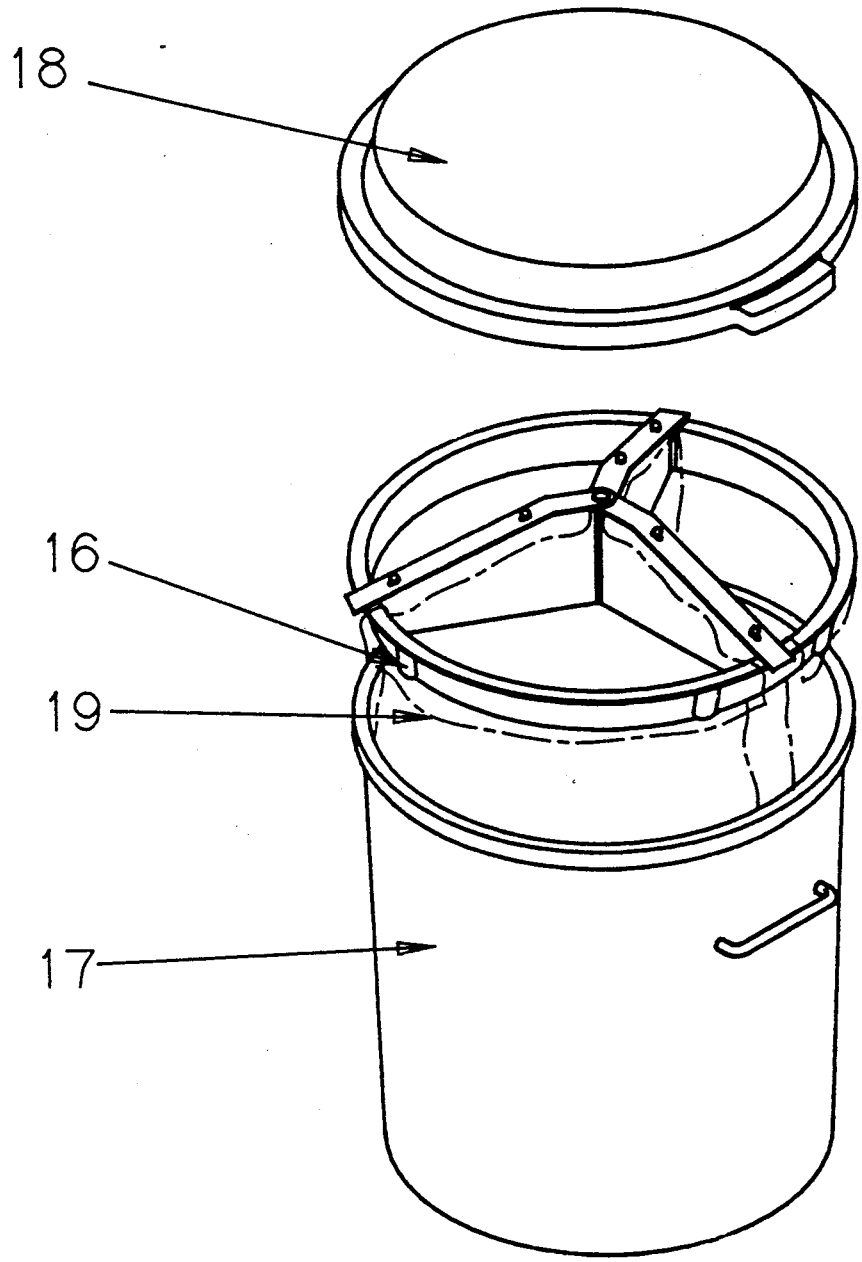
In FIG. 5, the device is shown with the complete bag holding assembly 16, including bags 19 over a trash can 17 with the lid 18 shown over the device.

In a third embodiment this can lid is made by injection molding. Injection molding reduces the scrap to nearly zero but at a considerable tooling cost. The tool will cost in excess of $100,000 but there will be no need to trim the part, no recycle material, and all holes will be in place in the mold. In this version the knobs 12 would still be supplied as customer installed parts to simplify the mold since the knob construction would require undercuts that complicate tooling. In a fourth embodiment, the can lid and the knobs are molded as a one piece structure with movable undercut parts in the mold as is well known in the art allowing the undercuts needed for the knobs. In such a part the knobs would be made with two flats on the sides as if a center slice through a knob was made to improve moldability of the knobs. The U shaped outer rim is reduced to a partial inside of the U shape as shown in FIG. 1, and the top can then accomodate the lid, as shown in FIG. 5, that is supplied with the container.

I claim:

1. A container top which is segmented into a multitude of segments by dividing rib means joined at a central point and extending radially to the rim of a trash container, each said dividing rib containing a plurality of projecting means, and each rib overlaid by a flexible strip containing gripping means interacting with said projecting means, each said flexible strip being attached at said central point, and where a portion of the top edge of a plastic bag is placed between said flexible strip and said dividing rib attaching plastic bags to said dividing ribs such that when said portion of the top edge of said plastic bags are placed over one said dividing rib, it hangs into the space defined by two adjacent ribs and the outer periphery of said container, and is gripped between said projections and said gripping means in said flexible strip.

2. The container top in 1 where said ribs terminate in a peripheral outer rim which is shaped to fit the rim of said trash container.

3. The container top in claim 1 where said flexible strip is a rubber or vinyl or urethane polymer and where said gripping means are holes in said flexible strip.

4. The container top in claim 1 where said flexible strip is attached to said central point of said dividing ribs by a pin shaped attaching means through said central point.

5. The container top in claim 1 where said projecting means are molded into said rib and which interact with holes or depressions in said flexible strip which are keyhole, obround, or oval in shape.

6. The container top in claim 1 where said projecting means are plastic knobs which are attached by attaching means to the top of said dividing ribs and interact with said holes when said strip is stretched.

7. A multicompartment storage system where plastic bags are used for storage and where a plurality of bags are each wrapped partially around an enclosing rib support and held in place by the interaction between a projecting knob located on said rib and holes in a flexible strip which are stretched and then are pressed over said projecting knob.

8. The storage system in 7 where said flexible strip is attached to said enclosing rib support.

9. The storage system in claim 8 where said at least two of said enclosing rib supports are wrapped with different sides of said plastic bags to hold said plastic bags in an open position.

10. A container top which consists of at least three ribs which extend from a center point to the periphery of said container and which have on the top of each said rib a flexible strip which can be elastically stretched is attached near the center end of said rib by attaching means, each of said flexible strips fit over the top of one said rib and each said flexible strip containing one or more holes, each hole positioned to interact, when stretched, with a projection which is upwardly directed from said rib such that said interaction holds part of the top portion of a bag which overlaps the top of said rib by contact between said projection and said hole in said flexible strip.

11. The claim in 10 where said ribs are attached to an outer rin which fits the top of said container.

12. The claim in 10 where said flexible strips are plasticized polymers.

13. The claim in 10 where said flexible strips are elastomers.

14. The claim in 10 where said flexible strips are urethane.

15. The claim in 11 where said projecting means are molded into said rib.

16. The claim in 10 where said attaching means consists of at least one staking pin which is pressed through a hole and holds said flexible strip to said ribs.

17. The claim in 10 where said attaching means is a screw or bolt or glue or solvent welds.

18. The claim in 11 where said container top is an injection molded plastic part and said projections are molded in place.

19. The claim in 11 where said container top is thermoformed and said projections are separate parts and said separate parts are attached by projection attaching means.

20. The claim in 10 where said device is sized to fit a lid.

* * * * *